US005930371A

United States Patent [19]

Cheng et al.

[11] Patent Number: 5,930,371

[45] Date of Patent: Jul. 27, 1999

[54] TUNABLE ACOUSTIC SYSTEM

[75] Inventors: C. Raymond Cheng, Madison, Wis.; Jason D. McIntosh, Savage, Minn.; Michael T. Zuroski, Sun Prairie; Larry J. Eriksson, Madison, both of Wis.

[73] Assignee: Nelson Industries, Inc., Stoughton, Wis.

[21] Appl. No.: 08/780,480

[22] Filed: Jan. 7, 1997

[51] Int. Cl.[6] ..... G10K 11/16

[52] U.S. Cl. ..... 381/71.5; 381/71.7

[58] Field of Search ..... 381/71.5, 71.7; 181/216, 219, 224

[56] References Cited

U.S. PATENT DOCUMENTS

| | | | |
|---|---|---|---|
| 3,620,330 | 11/1971 | Hall . | |
| 3,642,095 | 2/1972 | Fujii . | |
| 3,712,412 | 1/1973 | Hassett et al. . | |
| 4,665,549 | 5/1987 | Eriksson et al. . | |
| 4,677,676 | 6/1987 | Eriksson . | |
| 4,677,677 | 6/1987 | Eriksson . | |
| 5,044,464 | 9/1991 | Bremigan . | |
| 5,088,575 | 2/1992 | Eriksson . | |
| 5,119,427 | 6/1992 | Hersh et al. . | |
| 5,206,911 | 4/1993 | Eriksson . | |
| 5,216,721 | 6/1993 | Melton . | |
| 5,216,722 | 6/1993 | Popovich . | |
| 5,377,629 | 1/1995 | Brackett et al. . | |
| 5,390,255 | 2/1995 | Popovich . | |
| 5,418,873 | 5/1995 | Eriksson . | |
| 5,420,932 | 5/1995 | Goodman . | |
| 5,423,658 | 6/1995 | Pla et al. | 381/71.7 |
| 5,446,249 | 8/1995 | Goodman et al. . | |
| 5,513,266 | 4/1996 | Zuroski . | |
| 5,541,373 | 7/1996 | Cheng . | |
| 5,598,479 | 1/1997 | Dodt et al. | 381/71.7 |
| 5,621,656 | 4/1997 | Langley . | |
| 5,628,287 | 5/1997 | Brackett et al. . | |
| 5,636,286 | 6/1997 | Makabe et al. | 381/71.5 |

FOREIGN PATENT DOCUMENTS

0636207B1 6/1997 European Pat. Off. .

WO92/15088 9/1992 WIPO .

OTHER PUBLICATIONS

"Semi–Active Noise Control By A Resonator With Variable Parameters", S. Sato et al, Inter–Noise 90, pp. 1305–1308.

"Adaptive–Passive Noise Control With Self–Tuning Helmholtz Resonators", J.M. DeBedout et al, Journal of Sound And Vibration, 1997, 202(1), pp. 109–123.

"The Use of Resonators To Silence Centrifugal Blowers", G.H. Koopman et al, Nelson Acoustics Conference, Madison, Wisconsin, Jul. 15–16, 1981.

"The Use of Resonators To Silence Centrigual Blowers", G.H. Koopman et al, Journal of Sound and Vibration, 82(1), 1982, pp. 17–27.

"Active Noise Control To Reduce The Noise of Centrigual Fans", G.H. Koopman et al, 1985 ASME Ind. Poll. Cont. Sym., Dallas, TX, Feb. 17–21, 1985, pp. 31–36.

"An Actively Tuned, Passive Muffler System For Engine Silencing", J.S. Lamancusa, Noise–Con 87, The Pennsylvania State University, State College, PA, Jun. 8–10, 1987, pp. 313–318.

*Acoustics of Ducts and Mufflers* With Application To Exhaust And Ventilation System Design, M.L. Munjal, John Wiley & Sons, 1987, pp. 68–71.

(List continued on next page.)

*Primary Examiner*—Forester W. Isen

*Attorney, Agent, or Firm*—Andrus, Sceales, Starke & Sawall

[57] ABSTRACT

An acoustic resonator (20) has a resonator cavity (22) with a resonator port (24) for communicating with an exhaust flow passage (26) conducting acoustic waves therethrough. Adjustable port structure varies acoustic impedance of the port by various combinations including translation to vary area along an arcuate surface, translation between discrete areas, translation to cumulatively open port area, multiple translation, multiple ports, rotational area change, and rotational length change. Adaptive control may be provided. A combined passive and active acoustic system may also be provided.

29 Claims, 5 Drawing Sheets

OTHER PUBLICATIONS

"Active Source Cancellation of the Blade Tone Fundamental and Harmonics in Centrifugal Fans", G.H. Koopman et al, Journal of Sound and Vibration, 126(2), 1988, pp. 209–220.
"Characteristics of Dual Mode Mufflers", E. Suyama et al, Society of Automotive Engineers, Inc., Paper No. 890612, 1989.
"Muffler System Controlling An Aperture Neck of a Resonator", T. Izumi et al, International Symposium on Active Control of Sound and Vibration, Apr. 9–11, 1991, Tokyo, Japan, pp. 261–266.
"Advanced Design of Automotive Exhaust Silencers Systems", P. Krause et al, Society of Automotive Engineers, Inc., Paper No. 922088, 1992.
"Semiactive Control of Duct Noise by a Volumne–Variable Resonator", H. Matsuhisa et al, JSME International Journal, Series III, vol. 35, No. 2, pp. 223–228.
"Adaptive–Passive Noise Control", R.J. Bernhard et al, Inter–Noise, Toronto, Ontario, Canada, Jul. 20–22, 1992, pp. 427–430.
"Adaptive Tuned Vibration Absorbers: Tuning Laws, Tracking Agility, Sizing, And Physical Implementations", A.H. von Flotow et al, Noise–Con 94, Ft. Lauderdale, Florida, May 1–4, 1994, pp. 437–454.
"The State of The Art of Active–Passive Noise Control", R.J. Bernhard, Noise–Con 94, Ft. Lauderdale, FL, May 1–4, 1994, pp. 421–428.

202
CONTROLLER
160
206
200
190
188
168
198
194
192
196
178
174
176
162
182
180
M
M
170
172
186
184
164
204
166
210

TUNABLE ACOUSTIC SYSTEM

BACKGROUND AND SUMMARY OF THE INVENTION

The invention relates to tunable acoustic systems including resonator port structure, adaptive passive control, and passive and active combinations.

The invention arose during continuing development efforts relating to the subject matter of U.S. Pat. Nos. 4,665,549, 4,677,676, 4,677,677, 5,044,464, 5,088,575, 5,216,721, 5,216,722, 5,418,873, 5,420,932, 5,446,249, 5,513,266, 5,541,373, allowed application Ser. No. 08/273,919, filed Jul. 12, 1994, allowed application Ser. No. 08/322,585, filed Oct. 13, 1994, allowed application Ser. No. 08/368,920, filed Jan. 5, 1995, allowed application Ser. No. 08/355,456, filed Nov. 7, 1994, all incorporated herein by reference.

Acoustic resonators are known in the prior art. An acoustic resonator typically includes a resonator cavity having a resonator port communicating with an exhaust flow passage such as a duct or other outside space conducting acoustic waves therethrough. For example, the classical Helmholtz resonator comprises an air cavity coupled to the outside space through some form of opening such as an orifice, slot, tube, or the like. Such resonators are effective in reducing tonal noise over a narrow frequency band. The range of application of such silencers can be broadened by varying the acoustic impedance of the resonator to include additional tuned resonant frequencies. The resonant frequency can be varied by varying the volume of the resonator cavity and/or the area of the resonator port and/or the length of the resonator port.

The present invention provides simple and effective adjustable port structure varying acoustic impedance of the resonator port. The invention also provides adaptive passive systems. The invention further provides passive and active combinations. The latter are particularly desirable in applications where it is desired to reduce noise level prior to active attenuation, and to use the ability of the active portion of the system to do broadband control.

DETAILED DESCRIPTION OF THE INVENTION

Figure 1:
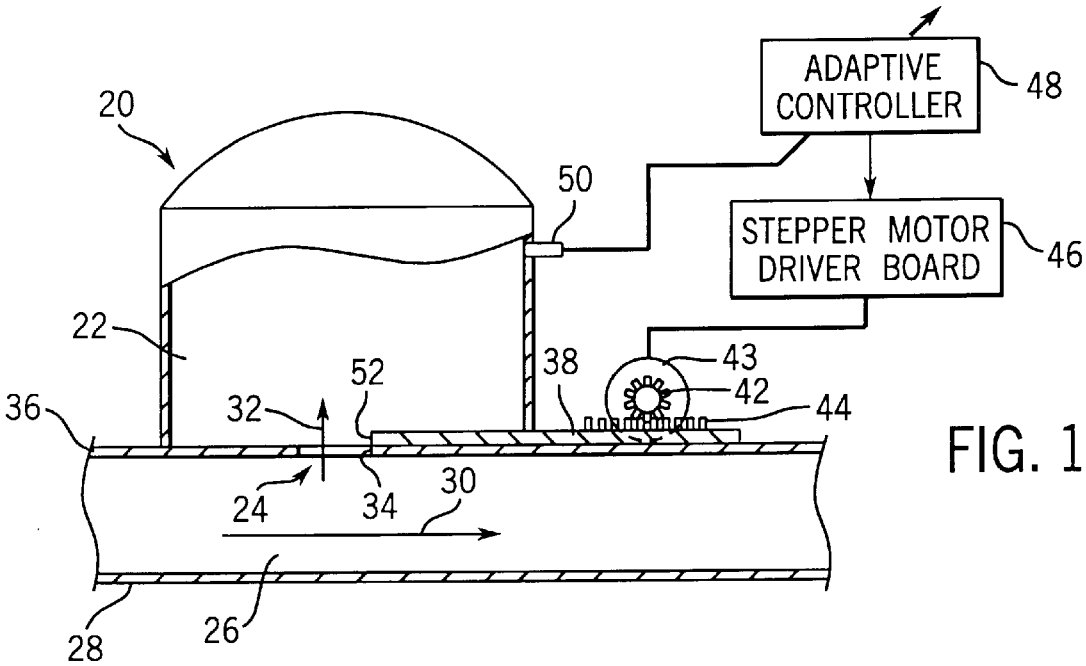
FIG. 1 is a schematic illustration of an acoustic resonator with adjustable port structure in accordance with the invention.

FIG. 1 shows an acoustic resonator 20 including a resonator cavity 22 having a resonator port 24 communicating with an exhaust flow passage 26, such as defined by a duct 28, or other outside space, conducting acoustic waves therethrough as shown at 30. Resonator port 24 defines an acoustic propagation path along a given direction 32 therethrough from exhaust flow passage 26 through circular opening 34 in duct top wall 36 into cavity 22. Port 24 has a length extending parallel to directional arrow 32. Port 24 has an area extending along a plane transverse to directional arrow 32. Such plane extends into the page in FIG. 1, and lies in the plane of the page in FIG. 2.

Figure 2:
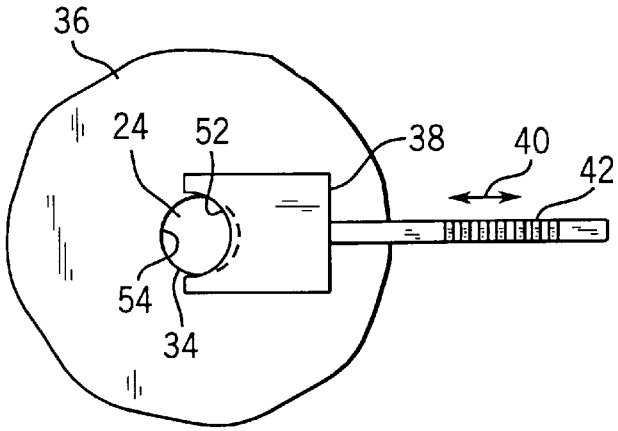
FIG. 2 is a top view of a portion of the structure of FIG. 1.

Adjustable port structure is provided by a plate 38 which is movable to vary the area of resonator port 24. In FIGS. 1 and 2, plate 38 is slidable left and right as shown at 40 to different positions varying the area of port 24. In FIG. 1, plate 38 is in a rightward position maximizing the area of port 24 and providing minimum acoustic impedance thereof. Upon movement of plate 38 leftwardly, FIG. 2, the area of port 24 is reduced, thus increasing acoustic impedance of port 24. Plate 38 may be manually slid left and right to desired positions for various desired tuned resonant frequencies. Alternatively, plate 38 may be automatically moved left and right, for example by a toothed pinion gear 42 on the output shaft of a motor 43 and engaging tooth rack 44 on plate 38 and driven by a stepper motor driver board 46 according to the output of an adaptive controller 48 having an error input from an error microphone 50 in resonator cavity 22. The adaptive controller 48 may be like that shown at model 40 in the above incorporated U.S. Pat. No. 4,677,676, and for tonal noise may use the error input from microphone 48 as the reference signal model input as in the above incorporated U.S. Pat. Nos. 5,206,911, 5,216,722.

Movement of plate 38 varies the area of resonator port 24 along arcuate surface 52 of plate 38. Movement of arcuate surface 52 nonlinearly varies the area of port 24. The adjustable port structure includes arcuate surface 52 of plate 38 and arcuate surface 54 of circular opening 34 of port 24. Arcuate surface 52 is movable toward and away from arcuate surface 54. Arcuate surface 52 is movable to a first position as shown in FIG. 1 providing minimum acoustic impedance of resonator port 24. In the position in FIG. 1, arcuate surface 52 is coextensive with the right half of arcuate surface 54 of opening 34. Arcuate surface 52 is movable along a movement direction 40, FIG. 2, transverse to direction 30 to vary the area of resonator port 24. In the embodiment in FIGS. 1 and 2, arcuate surface 52 is semicircular, and arcuate surface 54 is circular, and each have the same radius of curvature.

Figure 3:
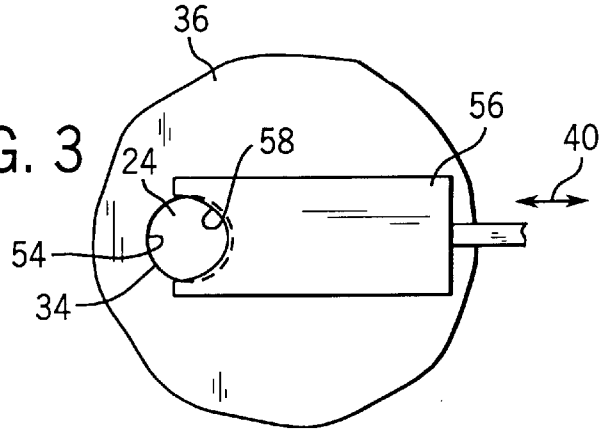
FIG. 3 is a view like FIG. 2 and shows an alternate embodiment.
Figure 8:
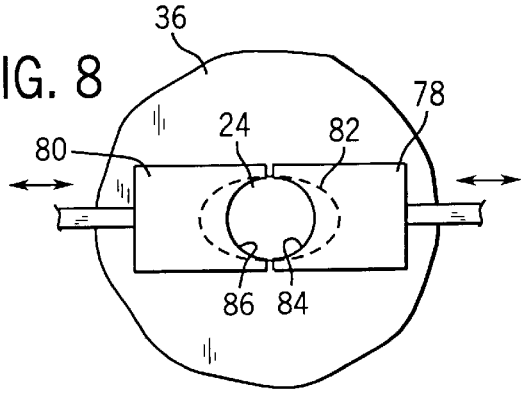
FIG. 8 is a view like FIG. 2 and shows further adjustable port structure.

FIG. 3 shows an embodiment similar to FIG. 2 but using a movable plate 56 with a parabolic arcuate surface 58. The opening 34 into resonator cavity 22 providing port 24 may be circular as shown in FIGS. 1 and 3, or may be elliptical as shown in FIGS. 6 and 8, and may be identical in shape and size to parabolic surface 58 or may be different.

Figure 4:
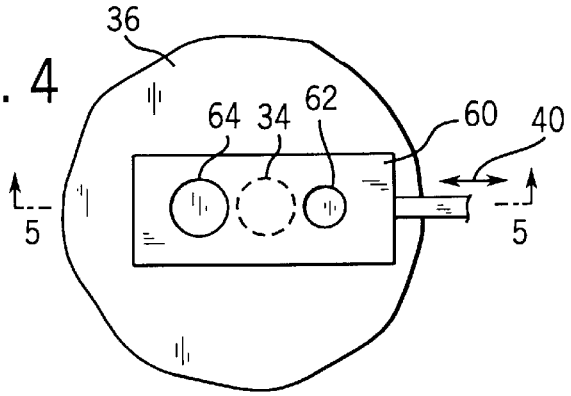
FIG. 4 is a view like FIG. 2 and shows further adjustable port structure.
Figure 5:
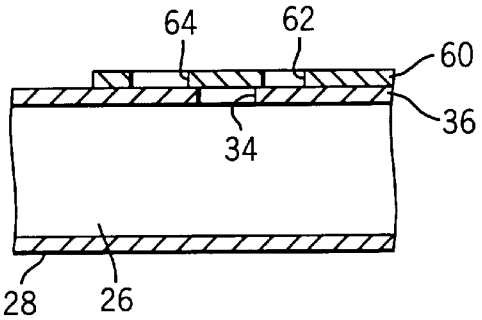
FIG. 5 is a sectional view taken along line 5—5 of FIG. 4.

FIGS. 4 and 5 show a movable plate 60 having circular cut-outs or openings 62 and 64. Top duct wall 36 has the noted cut-out or opening 34 of a given diameter. Plate 60 is movable left and right as shown at 40 in FIG. 4 relative to opening 34 to cover and uncover opening 34. Cut-outs 62 and 64 are spaced along plate 60 by a distance greater than the diameter of opening 34. Cut-outs 62 and 64 have different areas, further varying the area of resonator port 24. Plate 60 has at least three positions during its movement, namely a first position with cut-out 62 aligned with cut-out 34, a second position with cut-out 64 aligned with cut-out 34, and a third position with cut-out 34 aligned with neither of cut-outs 62 and 64.

Figure 6:
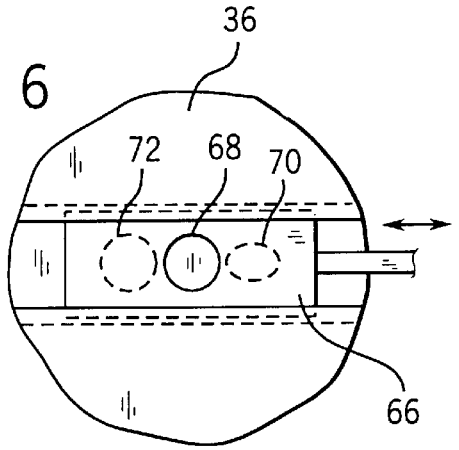
FIG. 6 is a view like FIG. 4 and shows an alternate embodiment.

In FIG. 6, the adjustable port structure includes movable plate 66 slidable left and right and having a cut-out 68. First and second openings 70 and 72 are provided in the wall 36 of duct 28, which openings communicate between exhaust flow passage 26 and resonator cavity 22. Openings 70 and 72 are spaced by a distance greater than the diameter of cut-out 68. Plate 66 is movable left and right relative to openings 70 and 72 to cover and uncover same, including to a position as shown in FIG. 6 with cut-out 68 between openings 70 and 72 and with plate 66 covering and closing openings 70 and 72. Openings 70 and 72 have different areas and different shapes. Plate 66 has at least three positions during its movement, including a first position with cut-out 70 aligned with cut-out 68, a second position with cut-out 72 aligned with cut-out 68, and a third position with cut-out 68 aligned with neither of cut-outs 70 and 72.

Figure 7:
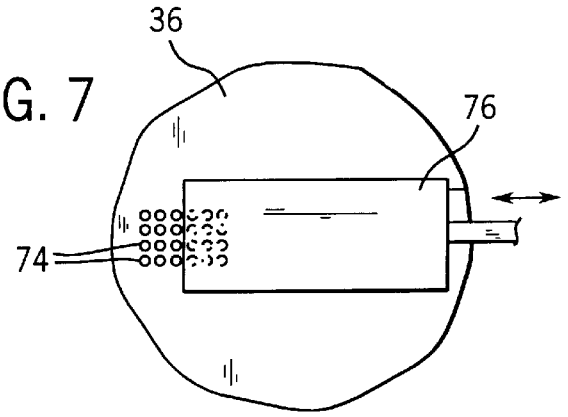
FIG. 7 is a view like FIG. 2 and shows further adjustable port structure.

In FIG. 7, the top wall 36 of duct 28 has a plurality of openings or cut-outs 74 covered and uncovered by plate 76 as it moves left and right. As plate 76 moves rightwardly in FIG. 7, it cumulatively uncovers cut-outs 74 to increase the area of port 24.

In FIG. 8, a pair of movable slide plates 78 and 80 are provided. The slide plates move left and right in FIG. 8 toward and away from each other. Duct wall 36 has an opening 82 of elliptical shape communicating between exhaust flow passage 26 and resonator cavity 22. Plates 78 and 80 move relative to opening 82. Plates 78 and 80 are movable to a first position as shown in FIG. 8 towards each other and having arcuate surfaces 84 and 86 in combination defining an area less than the area of elliptical opening 82.

Figure 9:
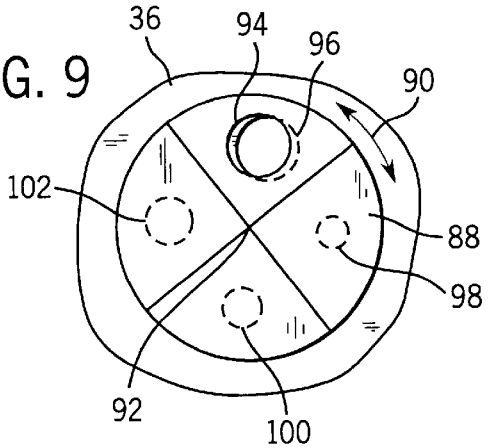
FIG. 9 is a view like FIG. 2 and shows further adjustable port structure with a different type of actuating movement.

In FIG. 9, movable plate 88 is rotational as shown at arrow 90 about a rotation axis 92 parallel to direction 30, FIG. 1. Plate 88 has a cut-out 94 movable along an arc upon rotation of plate 88. Duct wall 36 has a plurality of openings 96, 98, 100, 102 arranged in a circumferential pattern and communicating between exhaust flow passage 26 and resonator cavity 22. Cut-out 94 in plate 88 moves along the noted arc into alignment with respective of such openings upon rotation of plate 88 about axis 92. Minimum acoustic impedance of resonator port 24 is provided at maximum area thereof which in turn is provided when plate 88 is rotated to a position with cut-out 94 aligned with opening 96. Maximum acoustic impedance and minimum area of port 24 is provided when plate 88 is rotated to a position wherein cut-out 94 is aligned with none of openings 96, 98, 100, 102.

Figure 10A:
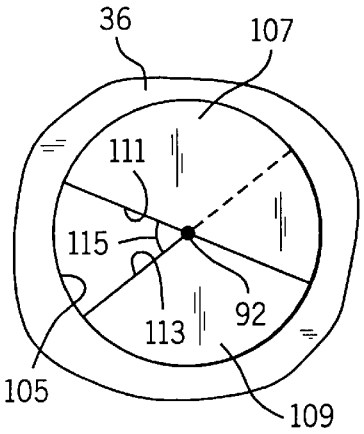
FIG. 10*a* is a view like FIG. 10 and shows an alternate embodiment.
Figure 10B:
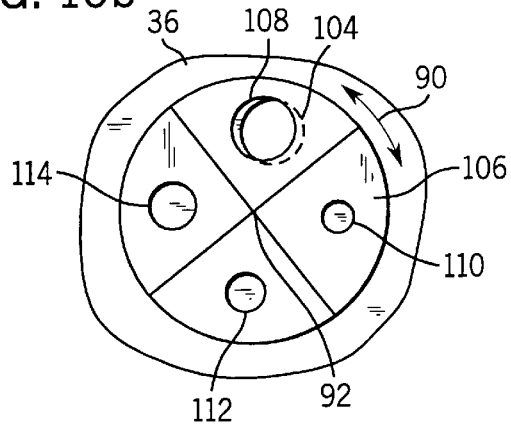
FIG. 10 is a view like FIG. 9 and shows an alternate embodiment.

In FIG. 10, duct wall 36 has an opening 104 communicating between exhaust flow passage 26 and resonator cavity 22. Rotational plate 106 has a plurality of cut-outs 108, 110, 112, 114 arranged in a circumferential pattern. Upon rotation of plate 106 about rotation axis 92, cut-outs 108, 110, 112, 114 move along an arc respectively into alignment with opening 104. In FIG. 10, minimum acoustic impedance of resonator port 24 is provided at maximum area thereof which in turn is provided when plate 106 is rotated to a position with cut-out 108 aligned with opening 104. Maximum acoustic impedance and minimum port area is provided when plate 106 is rotated to a position wherein none of cut-outs 108, 110, 112, 114 are aligned with opening 104.

In FIG. 10*a*, duct wall 36 has a circular opening 105 communicating between exhaust flow passage 26 and resonator cavity 22. A pair of semicircular rotational plates 107 and 109 are each rotatable about rotation axis 92. Semicircular plate 107 has a diameter extending transversely across axis 92 and providing an edge forming a surface 111 extending radially outwardly from axis 92. Semicircular plate 109 has a diameter extending transversely across axis 92 and providing an edge forming a surface 113 extending radially outwardly from axis 92. Upon rotation of one or both of plates 107 and 109 surfaces 111 and 113 move relative to each other toward or away from each other along an arc about rotation axis 92 to vary the area of the resonator port at opening 105. Surfaces 111 and 113 define an angle 115 therebetween. Semicircular plates 107 and 109 are rotatable to a fully aligned position, wherein angle 115 is 180°, providing maximum port area. The plates are rotatable to a fully misaligned position, wherein angle 115 is zero degrees, providing minimum or zero port area. The plates are rotatable to partially aligned positions, wherein 0°<angle 115<180°, providing respective pie-shaped openings of differing areas. In an alternate embodiment, one of the plates 107 and 109 is stationary. In a further alternate embodiment, one of the plates is eliminated, and duct opening 105 is semicircular. Plate 107 and/or 109 can include holes, shape variations, etc. as above.

Figure 11:
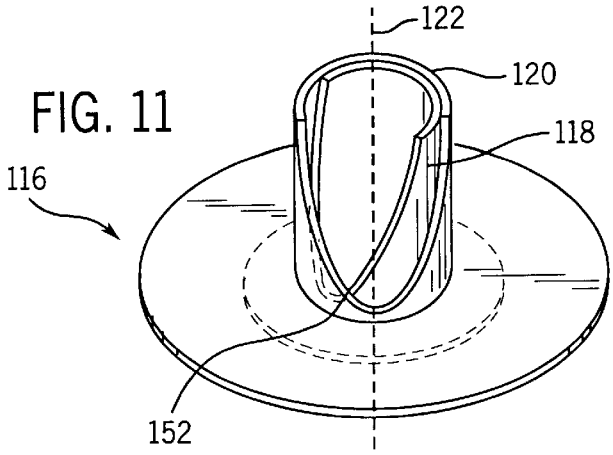
FIG. 11 is a schematic perspective view of further adjustable port structure.
Figure 12:
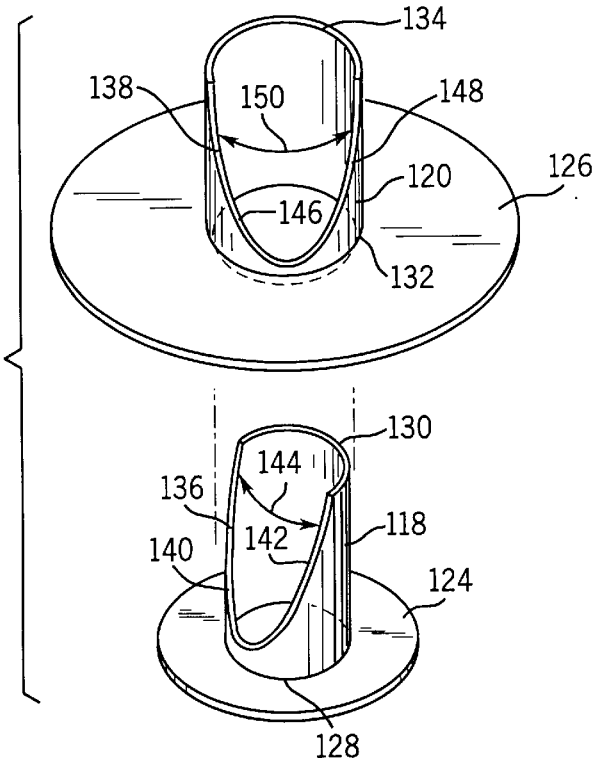
FIG. 12 is an exploded perspective view of the structure of FIG. 11.
Figure 13:
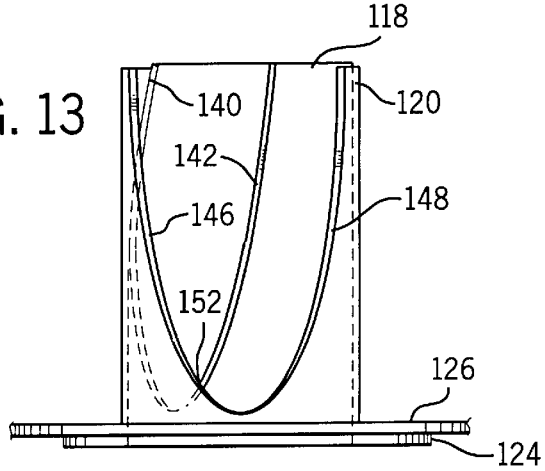
FIG. 13 is a side view, partially cut away, of the structure of FIG. 11.

FIGS. 11–13 show adjustable port structure for replacing plate 38 of FIG. 1 at resonator port 24. Adjustable port structure 116 of FIG. 11 varies acoustic impedance of the resonator port by varying the length of the port. A pair of cylindrical members 118 and 120 are provided, one of which is rotatable about a rotation axis 122 parallel to direction 30, which rotation changes the length of resonator port 24. Each cylindrical member 118 and 120 has a respective flange 124 and 126 extending radially therefrom. Cylindrical member 118 nests within cylindrical member 120, and the top of flange 124 abuts the underside of flange 126. Cylindrical member 120 surrounds cylindrical member 118 in concentric relation. In one embodiment, the top surface of flange 126 is mounted to the underside of top duct wall 36, FIG. 1, within exhaust flow passage 26, such that cylindrical member 120 is stationary, and cylindrical member 118 is rotatable about rotation axis 122. In another embodiment, the underside of flange 124 is mounted to the top surface of duct wall 36 and cylindrical member 118 is stationary, and cylindrical member 120 is rotatable about rotation axis 122. The following discussion describes the embodiment with inner member 118 being stationary and outer member 120 being rotatable, though such roles can be reversed, as noted.

Cylindrical member 118 has a cylinder axis 122 extending along the noted direction 30 from a first end 128 at exhaust flow passage 26 to a second end 130 in resonator cavity 22. Rotary member 120 is a second cylindrical member concentric with cylindrical member 118 and having a cylinder axis 122 extending along the noted direction 30 from a first end 132 at exhaust flow passage 26 to a second end 134 in resonator cavity 22. First a second cylindrical members 118 and 120 have respective cut-outs 136 and 138 in their respective cylindrical sidewalls which align and misalign upon rotation of cylindrical member 120. The length of the resonator port is lesser when cut-outs 136 and 138 align, and greater when such cut-outs misalign.

Cut-out 136 extends from end 130 of cylindrical member 118 toward end 128. Cut-out 136 has sides 140 and 142 tapering towards each other as cut-out 136 extends away from cylinder end 130. Cut-out 136 defines a gap 144 in the cylindrical sidewall of cylindrical member 118, which gap has a lateral width between sides 140 and 142 and extending transversely to the noted direction 30. The lateral width of gap 144 decreases as cut-out 136 extends away from cylinder end 130. Cut-out 138 has first and second sides 146 and 148 tapering towards each other as cut-out 136 extends away from end 134 of cylindrical member 120. Cut-out 138 defines a gap 150 in the cylindrical sidewall of cylindrical member 120. Gap 150 has a lateral width between sides 146 and 148 which extends transversely to the noted direction 30. The lateral width of gap 150 decreases as cut-out 136 extends away from cylinder end 134.

During rotation of cylindrical member 120 clockwise about rotation axis 122, side 148 of cut-out 138 moves toward side 140 of cut-out 136. Side 148 of cut-out 138 meets side 140 of cut-out 136 at a junction 152. As cylindrical member 120 continues to rotate clockwise, junction 152 moves along the noted direction 30 toward cylinder ends 130 and 134, increasing the length of the resonator port. During rotation of cylindrical member 120 in the counter-clockwise rotational direction, side 148 of cut-out 138 moves away from side 140 of cut-out 136, and junction 152 moves toward cylinder ends 128 and 132, decreasing the length of the resonator port.

In the preferred embodiment, each cut-out 136 and 138 at its maximum width extends along an arc which is 50% or less of the circumference of the respective cylindrical member. Each of cut-outs 136 and 138 is preferably parabolic in shape. Cylindrical member 120 surrounds cylindrical member 118 and is coaxial therewith. Cylindrical member 118 is fixed relative to exhaust flow passage 26 as is cavity 22, and the adjustable port structure varies the length of resonator port 24 without moving cavity 22 relative to exhaust flow passage 26.

Figure 14:
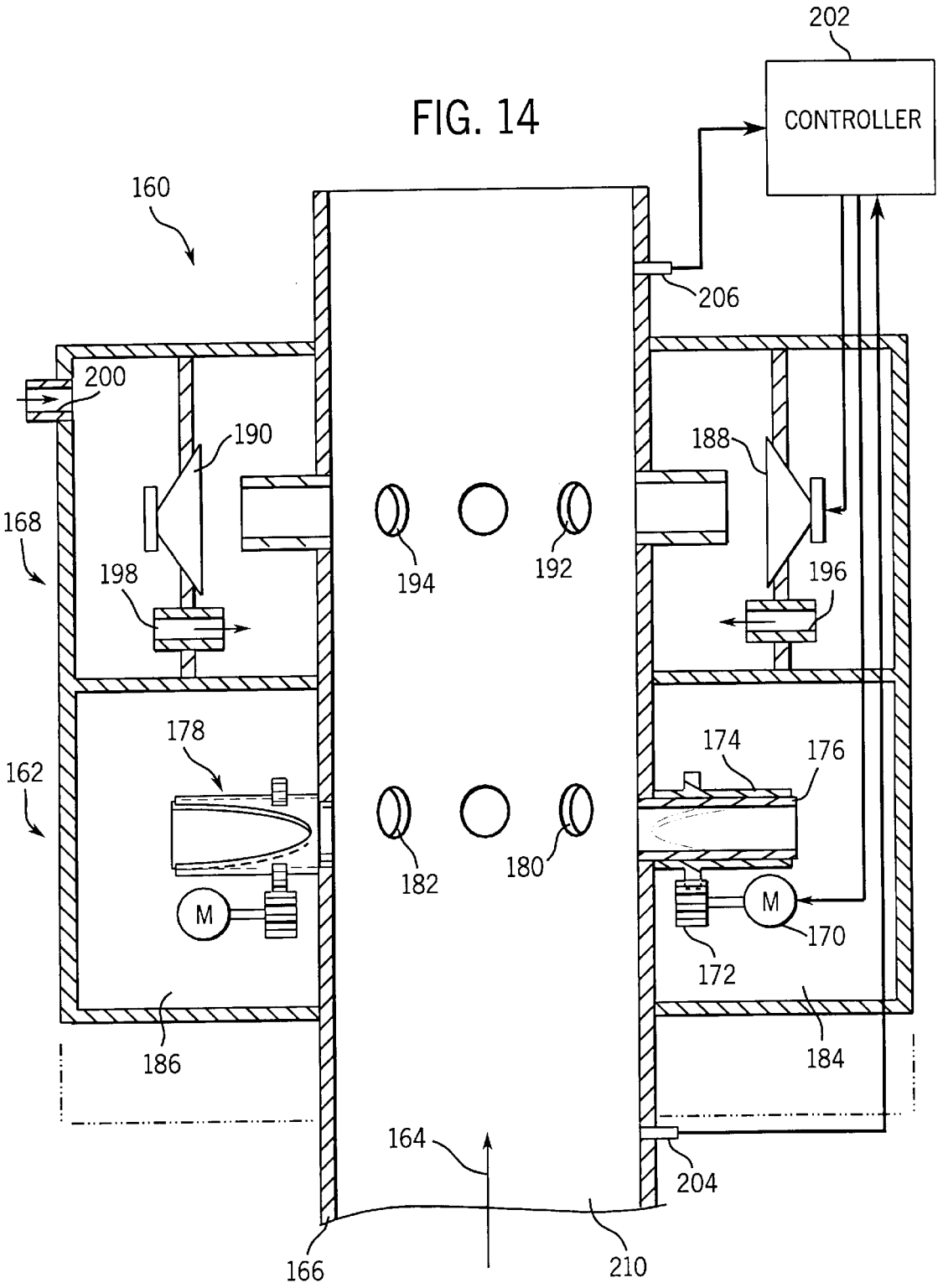
FIG. 14 is a schematic illustration of an acoustic system in accordance with the invention.

FIG. 14 shows an acoustic system 160 including a passive acoustic section 162 passively interacting with an input acoustic wave as shown at 164 traveling through duct 166, and an active acoustic section 168 actively interacting with the input acoustic wave. The passive acoustic section includes a first transducer provided by a motor 170 driving pinion gear 172 for altering the passive acoustic system to vary interaction with the input acoustic wave, for example by rotating outer cylindrical member 174 concentric to inner stationary cylindrical member 176, which cylindrical members are comparable to respective cylindrical members 120 and 118 in FIGS. 11–13. The passive acoustic section may include other acoustic resonators such as 178 communicating with the exhaust flow passage in duct 166 through respective openings 180, 182 providing respective acoustic resonator ports for respective resonator cavities 184, 186. The passive acoustic section may include other types of acoustic resonators such as shown in FIGS. 1–10, as well as other types of passive acoustic systems. The active acoustic section includes an output transducer 188 provided by a loudspeaker injecting a generated acoustic wave to actively interact with the input acoustic wave in duct 166. Other canceling loudspeakers such as 190 may be provided for injecting respective canceling acoustic waves through respective openings 192, 194. Vent passages such as 196, 198, 200 may be provided as appropriate. An adaptive controller 202 has a reference input from a reference signal correlated with the input acoustic wave at 164, for example as sensed at reference input microphone 204. Controller 202 has an error input from an error transducer provided by error microphone 206 sensing the interaction of the passive acoustic section 162 and the active acoustic section 168 with the input acoustic wave. The controller has model outputs outputting correction signals to the output transducers such as 170 and 188 to vary the noted interactions with the input acoustic wave, for example as in the above noted incorporated U.S. Pat. No. 4,677,676. Controller 202 may additionally control the other output transducers such as at 190 and 178, for example as in the above incorporated U.S. Pat. No. 5,216,721.

Exhaust flow passage 210 in duct 166 conducts the input acoustic wave therethrough along a given flow direction as shown at 164. Active acoustic sections 168 are downstream of the passive acoustic sections 162 along such flow direction. Error microphone 206 is downstream of the passive and active acoustic sections along the flow direction. It is preferred that passive acoustic sections 162 absorb and/or null most of the input noise, and active sections 168 cancel the balance.

It is recognized that various equivalents, alternatives and modifications are possible within the scope of the appended claims.

We claim:

1. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, adjustable port structure varying acoustic impedance of said port by varying of one said length and said area of said port along a movable arcuate surface, wherein said adjustable port structure comprises a pair of arcuate surfaces, including a first arcuate surface movable toward and away from a second arcuate surface, and wherein said first and second arcuate surfaces have different radii of curvature.

2. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, adjustable port structure varying acoustic impedance of said port by varying of one said length and said area of said port along a movable arcuate surface, wherein said adjustable port structure comprises a pair of arcuate surfaces, including a first arcuate surface movable toward and away form a second arcuate surface, and wherein said first arcuate surface is rotatable about a rotation axis parallel to said given direction to vary said area of said port.

3. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, adjustable port structure varying acoustic impedance of said port by varying of one said length and said area of said port along a movable arcuate surface, wherein said adjustable port structure comprises a pair of arcuate surfaces, including a first arcuate surface movable toward and away form a second arcuate surface, and wherein said first arcuate surface is rotatable about a rotation axis parallel to said given direction to vary said length of said port.

4. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, adjustable port structure comprising a movable plate having first and second cut-outs and varying acoustic impedance of said port by movement varying one of said length and said area of said port, wherein said adjustable port structure comprises an opening of given diameter between said exhaust flow passage and said cavity, and wherein said plate is movable relative to said opening to cover and uncover said opening, said first and second cut-outs being spaced along said plate by a distance greater than said given diameter, and wherein said first and second cut-outs have different areas.

5. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, adjustable port structure comprising a movable plate having a cut-out, and comprising first and second openings communicating between said exhaust flow passage and said cavity and spaced by a distance greater than the transverse dimension of said cut-out in said plate, said plate being movable relative to said openings to cover and uncover same, including to a position with said cut-out between said first and second openings and said plate covering and closing said first and second openings, wherein said first and second openings have different areas.

6. An acoustic resonator comprising a resonator cavity having a resonator port for communicating with an exhaust flow passage conducting acoustic wave therethrough, said resonator port defining an acoustic propagation path along a given direction therethrough from said exhaust flow passage into said cavity, said port having a length extending parallel to said given direction, said port having an area extending along a plane transverse to said given direction, adjustable port structure comprising a movable plate having a cut-out, and comprising first and second openings communicating between said exhaust flow passage and said cavity and spaced by a distance greater than the transverse dimension of said cut-out in said plate, said plate being movable relative to said openings to cover and uncover same, including to a position with said cut-out between said first and second openings and said plate covering and closing said first and second openings, wherein said first and second openings have different shapes.

7. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, adjustable port structure comprising a plate rotational about a rotation axis parallel to said given direction and having a cut-out movable along an arc upon rotation of said plate and varying acoustic impedance of said port by varying one of said length and said area of said port.

8. The resonator according to claim 7 wherein said adjustable port structure comprises a plurality of openings arranged in a circumferential pattern and communicating between said exhaust flow passage and said cavity, said cut-out in said plate being movable along said arc into alignment with respective said openings.

9. The resonator according to claim 7 wherein said adjustable port structure comprises an opening communicating between said exhaust flow passage and said cavity, and wherein said plate has a plurality of cut-outs arranged in a circumferential pattern and movable along said arc respectively into alignment with said opening upon rotation of said plate.

10. The resonator according to claim 7 wherein said plate comprises a first semicircular plate rotatable about said rotation axis, and comprising a second semicircular plate rotatable about said rotation axis, said plates being rotatable to a fully aligned position providing maximum port area, said plates being rotatable to a fully misaligned position providing minimum port area, said plates being rotatable to partially aligned positions providing respective pie-shaped openings of differing areas.

11. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, adjustable port structure comprising a first surface movable by rotation about a rotation axis parallel to said given direction to a first position providing minimum acoustic impedance of said port, and movable by rotation about said rotation axis to a second position providing maximum acoustic impedance of said port.

12. The resonator according to claim 11 wherein rotation of said surface about said rotation axis varies said area of said port.

13. The resonator according to claim 11 wherein rotation of said surface about said rotation axis varies said length of said port.

14. The resonator according to claim 11 wherein said surface extends radially outwardly from said rotation axis, and comprising a second surface extending radially outwardly from said rotation axis, said first and second surfaces being movable relative to each other toward and away from each other along an arc about said rotation axis to vary said area of said port.

15. The resonator according to claim 14 comprising a first plate rotatable about said rotation axis and having an edge providing said first surface, and a second plate rotatable about said rotation axis and having an edge providing said second surface.

16. The resonator according to claim 15 wherein each of said first and second plates is semicircular.

17. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, adjustable port structure varying acoustic impedance of said port, said adjustable port structure comprising first and second members movable relative to each other, at least one of said members having a plurality of cut-outs covered and uncovered by the other member during said relative movement, wherein a first of said members is rotatable about a rotation axis parallel to said given direction to vary said area of said port.

18. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, adjustable port structure varying acoustic impedance of said port between said exhaust flow passage and said cavity by varying the length of said port and comprising a rotary member rotatable about a rotation axis parallel to said given direction, and wherein rotation of said rotary member about said rotation axis changes said length of said port.

19. The resonator according to claim 18 wherein said port structure comprises a first generally cylindrical member having a cylinder axis extending along said given direction from a first end at said exhaust flow passage to a second end in said cavity, said rotary member comprises a second generally cylindrical member concentric with said first cylindrical member and having a cylinder axis extending along said given direction from a first end at said exhaust flow passage to a second end in said cavity, said first and second cylindrical members having cut-outs in their cylindrical sidewalls which align and misalign upon rotation of said second cylindrical member, said length of said port being lesser when said cut-outs align, and greater when said cut-outs misalign.

20. The resonator according to claim 19 wherein said first cut-out extends from said second end of said first cylindrical member toward said second end of said first cylindrical member, said first cut-out having first and second sides tapering towards each other as said first cut-out extends away from said second end of said first cylindrical member, said first cut-out defining a first in the cylindrical sidewall of said first cylindrical member, said first having a lateral width between said first and second sides and extending transversely to said given direction, said lateral width of said first decreasing as said first cut-out extends away from said second end of said first cylindrical member, said second cut-out extends from said second end of said second cylindrical member toward said second end of said second cylindrical member, said second cut-out having first and second sides tapering towards each other as said second cut-out extends away from said second end of said second cylindrical member, said second cut-out defining a second in the cylindrical sidewall of said second cylindrical member, said second having a lateral width between said first and second sides of said second cut-out and extending transversely to said given direction, said lateral width of said second decreasing as said second cut-out extends away from said second end of said second cylindrical member.

21. The resonator according to claim 20 wherein:

during rotation of said second cylindrical member in one rotational direction, said second side of said second cut-out moves toward said first side of said first cut-out, and said second side of said second cut-out meets said first side of said first cut-out at a junction which moves along said given direction toward said second ends of said first and second cylindrical members, increasing said length of said port; and during rotation of said second cylindrical member in the opposite rotational direction, said second side of said second cut-out moves away from said first side of said first cut-out, and said junction moves toward said first ends of said first and second cylindrical members, decreasing said length of said port.

22. The resonator according to claim 21 wherein each said cut-out at its maximum width extends along an arc which is 50% or less of the circumference of the respective said cylindrical member.

23. The resonator according to claim 22 wherein each of said cut-outs is parabolic in shape.

24. The resonator according to claim 19 wherein said second cylindrical member surrounds said first cylindrical member and is coaxial therewith.

25. The resonator according to claim 24 wherein said first cylindrical member is fixed relative to said exhaust flow passage.

26. The resonator according to claim 18 wherein said cavity is fixed relative to said exhaust flow passage, and said adjustable port structure varies said length of said port without moving said cavity relative to said exhaust flow passage.

27. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, an adaptive controller driving adjustable port structure varying acoustic impedance of said port by varying one of said length and said area of said port, said exhaust flow passage having an input receiving an input acoustic wave, and an output outputting an output acoustic wave, said controller comprising an adaptive filter model having a model input from a reference signal correlated to said input acoustic wave, a model output outputting a correction signal to said adjustable port structure, and an error input receiving an error signal from an error transducer sensing said output acoustic wave, wherein said adjustable port structure comprises a plate rotational about a rotation axis parallel to said given direction and having a cut-out movable along an arc upon rotation of said plate and varying acoustic impedance of said port by varying one of said length and said area of said port.

28. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, an adaptive controller driving adjustable port structure varying acoustic impedance of said port by varying one of said length and said area of said port, said exhaust flow passage having an input receiving an input acoustic wave, and an output outputting an output acoustic wave, said controller comprising an adaptive filter model having a model input from a reference signal correlated to said input acoustic wave, a model output outputting a correction signal to said adjustable port structure, and an error input receiving an error signal from an error transducer sensing said output acoustic wave, wherein said adjustable port structure comprises a first surface movable by rotation about a rotation axis parallel to said given direction to a first position providing minimum acoustic impedance of said port, and movable by rotation about said rotation axis to a second position providing maximum acoustic impedance of said port.

29. An acoustic resonator comprising a resonator cavity having a resonator port for communicating with an exhaust flow passage conducting acoustic waves therethrough, said resonator port defining an acoustic propagation path along a given direction therethrough from said exhaust flow passage into said cavity, said port having a length extending parallel to said given direction, said port having an area extending along a plane transverse to said given direction, an adaptive controller driving adjustable port structure varying acoustic impedance of said port by varying one of said length and said area of said port, said exhaust flow passage having an input receiving an input acoustic wave, and an output outputting an output acoustic wave, said controller comprising an adaptive filter model having a model input from a reference signal correlated to said input acoustic wave, a model output outputting a correction signal to said adjustable port structure, and an error input receiving an error signal from an error transducer sensing said output acoustic wave, wherein said adjustable port structure varies acoustic impedance of said port between said exhaust flow passage and said cavity by varying the length of said port.

* * * * *